United States Patent [19]

Dillard

[11] Patent Number: 4,915,001

[45] Date of Patent: Apr. 10, 1990

[54] VOICE TO MUSIC CONVERTER

[76] Inventor: Homer Dillard, 12667 Lonsdale, Bridgeton, Mo. 63044

[21] Appl. No.: 226,957

[22] Filed: Aug. 1, 1988

[51] Int. Cl.[4] ..... G10H 1/00; G10H 1/02; G10H 3/03

[52] U.S. Cl. ..... 84/600; 84/622

[58] Field of Search ..... 84/1.2, 470 R, 1.27, 84/3, 1.11-1.12, 1.28, 119-124, 1.25, 1.01; 381/38, 51, 61

[56] References Cited

U.S. PATENT DOCUMENTS

| | | | |
|---|---|---|---|
| 3,999,456 | 12/1976 | Tsunoo et al. | 84/1.01 |
| 4,168,645 | 9/1979 | Squire et al. | 84/1.19 X |
| 4,369,336 | 1/1983 | Agnello | 84/1.24 X |
| 4,463,650 | 8/1984 | Rupert | 84/1.19 |
| 4,464,784 | 8/1984 | Agnello | 381/61 |
| 4,596,032 | 6/1986 | Sakurai | 84/1.01 X |
| 4,633,748 | 1/1987 | Takashima et al. | 84/1.01 |
| 4,658,691 | 4/1987 | Ishibashi | 84/1.19 |
| 4,664,010 | 5/1987 | Sestero | 84/1.01 |
| 4,667,556 | 5/1987 | Hanzawa et al. | 84/1.28 X |
| 4,681,008 | 7/1987 | Morikawa et al. | 84/1.01 X |
| 4,683,793 | 8/1987 | Deutsch | 84/1.01 |
| 4,726,067 | 2/1988 | Alonso | 84/1.27 X |
| 4,757,737 | 7/1988 | Conti | 84/1.21 X |

FOREIGN PATENT DOCUMENTS

| | | | |
|---|---|---|---|
| 1393542 | 5/1975 | United Kingdom | 84/1.01 |
| 2171837 | 9/1986 | United Kingdom | 84/1.01 |

*Primary Examiner*—A. T. Grimley
*Assistant Examiner*—Matthew S. Smith
*Attorney, Agent, or Firm*—Henry W. Cummings

[57] ABSTRACT

An electronic means for changing the pitch of a musical instrument or the human voice utilizes contra-rotating write and read vectors in the same memory space to translate an input signal waveform configuration into a time repetitive output waveform of controlled periodicity, resulting in a plurality of harmonious pleasing voices or tones or unison voices (or tones) with respect to the tones or voices inputted to the device.

27 Claims, 8 Drawing Sheets

VOICE TO MUSIC CONVERTER

BACKGROUND AND SUMMARY OF THE INVENTION

Means for electronically changing the pitch of a musical instrument or the human voice, commonly referred to as a "speed up loop", "pitch changer", "slow down loop" or "Harmonizer (TM)" was first developed over ten years ago. These devices are used extensively in recording studios to correct musical pitch and in variable speech control devices to correct picth while varying a tape recorder's playback speed.

These known devices employ a means for quantizing the speech or music audio, storing the quantized analong signal in a memory by means of a write vector, and reading the memory space with a read vector, converting the quantized read signal to analog form and playing out the read analog signal by means of an audio amplifier and loud speaker. In these known devices, the write and read vectors rotate through the memory space in the same direction with variable angular velocities. If both vectors have the same angular velocities, no-pitch change occurs. However, delays can be effected by varying the angular separation between the two vectors, thereby accomplishing phase or time delays in the signal output relative to the signal input. If the write vector angular position moves more than the read vector in the same time period, then the pitch in the output signal decreases. Conversely, if the read vector rotates faster than the write vector, then the pitch in the output signal increases. For either case, the pitch change is proportional to the ratio of the two angular velocities.

This prior art exhibits limitations wherrein the write and read vectors intercept each other in the memory space. A discontinuity commonly referred to as a "glitch" occurs in the read signal at the intercept point. This glitch produces unwanted noise frequencies in the output at the glitch rate and its harmonics. Digital signal processing algorithms and special hardware filtering methods have been developed to de-emphasize the noise glitch.

This prior art exhibits further limitations wherein the output signal pitch is a fixed musical interval away from the input reference pitch. Musical intervals of 5ths, 3rds, octaves, etc. may be selectable, however, the output remains fixed for the selected interval. Multiple devices are required to create a trio or quartet from a single voice input. Associated switching is required to vary the chord structure eg. dominant 7th, tonic, augmented, diminished, etc.

This prior art exhibits even further limitations when the output pitch is lowered with respect to the input pitch. In this instance, information is lost since the write vector overwrites information that is never read by the read vector because the write vector is traveling faster then the read vector through the memory space.

SUMMARY OF THE INVENTION

To solve the problems of the prior art which limited the applicablity and usefulness of the pitch changer, the invention herein has developed a technique for translating an input signal waveform configuration into a time repetitive output waveform configuration of controlled periodicity. These resultant periodic waveforms, which occur at a lower frequency than the input, can be analyzed as producing a Fourier series of harmonics of the repetition frequency. These resultant harmonic frequencies produce pleasing harmonies with respect to the input signal.

The input waveform of the signal is reverse sequenced in time and convolved with the instantaneous forward sequenced input waveform of the signal. The resultant components are summed in a summing amplifier and converted to audible sound by means of an audio amplifier and a loud speaker.

A potentiometer is used to vary the reverse sequenced waveform level with respect to the forward sequenced waveform.

In accordance with the present invention a plurality of voices musically related to an input voice can be produced by means of a single or multiple write and read vectors. The invention is an advancement in the musical instrument state of the art in voice augmentation and is tunable to any chromatic root note of given key signature. Tuning is effective for multiple keys and key signatures and note changes at the input. The invention automatically evokes multi note chords at the output from a single voice input even when keys or key signature is changed during a song sequence ie. within the song. Tuning is effective wherein the person singing into the invention can change keys and the accompaning voices coming from the invention also change keys making the invention effective as a voice training medium. The tuning can be crystal controlled requiring perfect pitch from the singer to achive proper unison. Pitch can be set ie. international A=440, standard or variable.

Varying input signal waveforms can be re-configured at the output to be quasi-stationary, unison, un-changed, replicas of variable amplitude of fixed or variable phase, completely canceled, and made time axially symmetric with respect to the input signal periodicity, all of which can be accomplished without changing the tuning.

A reverse time sequenced waveform containing an integer number of periods has the same spectral content as a forward sequenced waveform of the same wave shape.

A forward writing and a reverse reading vector at the same angular velocities produce a plurality of harmonious voices from a single voice input. A forward writing and a reverse reading vector at equal angular velocities results in zero information loss in the output signal relative to the input signal. A forward writing and a reverse reading vector is identical to a reverse writing and forward reading vector. The vectors only need to be contra-rotating in the memory space at the same angular velocity.

The controlled parameters used in the invention are simply the quantizing or sampling rate and the contiguous memory length. The combined parameters control the angular velocity of both read and write vectors through the memory space. Tuning of the invention can be accomplished by varying either of the control parameters.

A means for complementing an incrementing binary address produces a decrementing binary address for both read and write vector control, and with proper timing, shared read/write appear simultaneous. The complementing means can be a plurality of exclusive OR gates.

The discontinuity or "glitch" cause by the intercepting write and read vectors can be used to advantage by contra-rotating the vectors, thus producing a time repetitive wave form of controlled periodicity and other configurations as defined herein. Melodic harmonic frequencies occur when the time repetitive waveform resulting from the summation of the signals read in one rotational direction and written oppositely in the same memory space are periodically repetitive at frequencies lower than either the input frequency or that defined by the angular velocities of the contra-rotating read and write vectors.

The harmonic frequencies that occur at integer multiples of the lower repetition frequency, from the paragraph above, produce pleasing musical harmonies with respect to the frequency of the input signal. Pleasing musical harmonies occur in varying intervals including 4th, 5th, and 6th harmonics which coresspond to tonic triads and/or other integer harmonics such as octaves depending upon the turning, input frequencies and relative phasing between the write/read vectors and that of the input signal.

For optimum tuning of the invention, the cyclic rate of the read vector and write vector can be set to be equal to the frequency of a musical note an octave below a musical note; that is a 5th musical interval (based on the 12th root of two=1.0594631) below the key signature ie. F of a key ie. F in which notes of its diatonic scale, produce pleasing musical chords or plurality of voices.

The timbre of the musical chord output from the invention can be varied in the number of voices/harmonics by incrementing or decrementing the relative phase between the angular velocity of the write/read vectors and the angular velocity of the input note frequency.

unison notes or voices are output from the invention when unison notes or voices are input to the invention if the unison input notes or voices are octavely related or 7 intervals including chromatics above (3rd harmonic frequency relationship and its octaves) the cyclic rate of the read/write vectors.

A "tremolo" or amplitude modulation of the unison notes can be achieved by varying the relative phase between the input note/voice and that of the read/write vectors, with maximum amplitude occuring at 180 degrees and minimum amplitude occuring at 0 degrees starting or relative phase.

A "vibrato" or frequency modulation of the notes/-voices output from the invention can be effected by frequency modulating the digital clock controlling the angular velocity of the read/write vectors. This vibrato depth and rate being independent of the input signal.

The invention constitutes a diatonic scale instrument, that when once optimally tuned to a given key, as defined above; is operable in chromatic key shifts of ±5 half steps from the given key without re-tuning the instrument.

The prefered embodiment of the invention provides 12 chromatically selectable key signatures plus continuous tuning of ±one half step.

The foregoing has been a brief description of the principal advantages and features of the present invention. A more thorough understanding thereof may be attained by referring to the drawings and descriptions of the embodiments which follow.

DESCRIPTION OF THE PREFERRED EMBODIMENTS

There are multiple embodiments of the invention using hardware and software techniques. Two embodiments are described herein one involving hardware implemention and the other microprocessor control of hardware via an algorithm.

Figure 1:
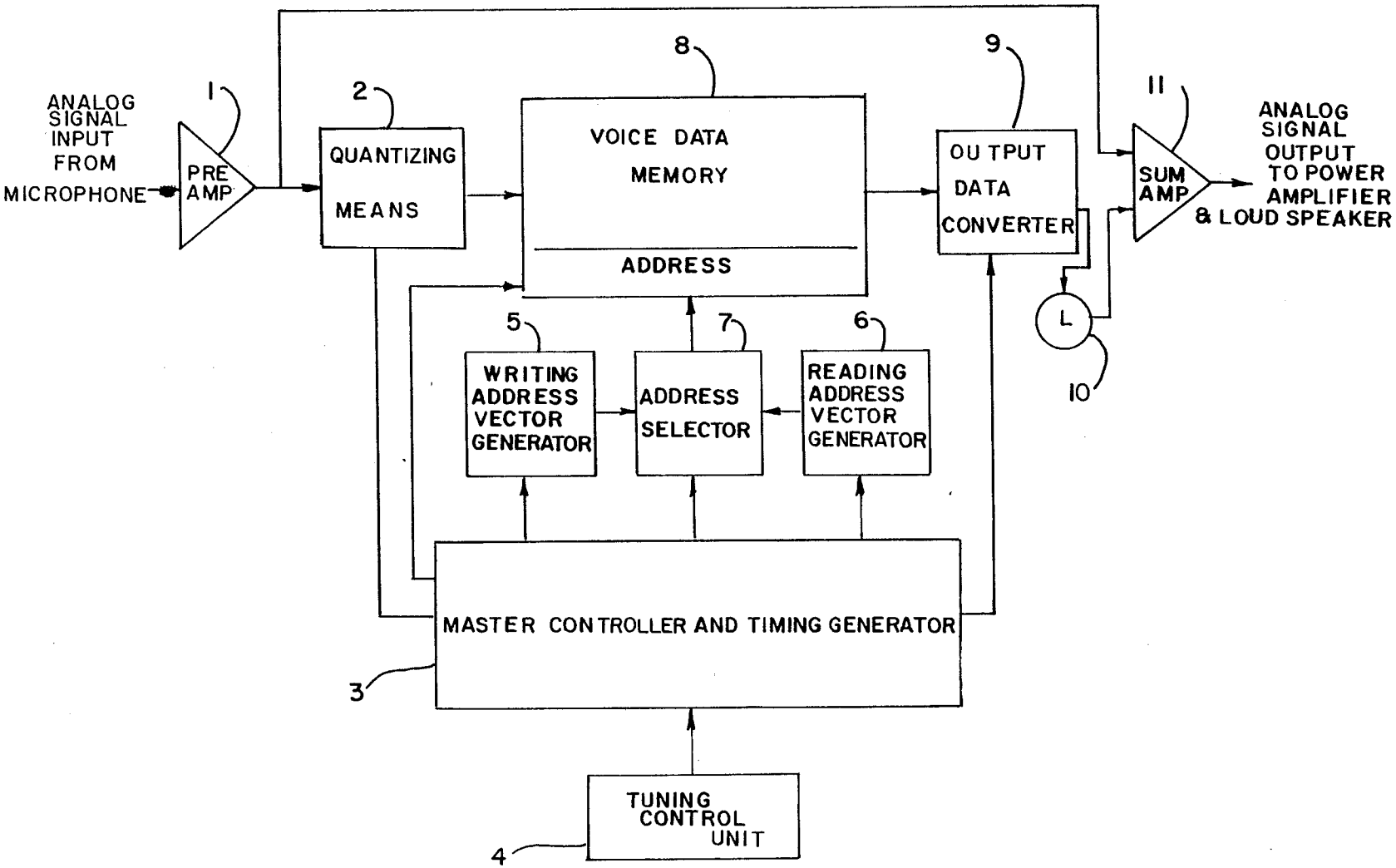
FIG. 1 is a block diagram of an electronic system for Voice To Music Conversion including the means for signal amplification, signal conversion, vector generation, tuning, data control, data storage and output signal summation of the present invention.

The preferred embodiment embodiment is shown in FIG. 1 and includes a pre-amplifier 1 which amplifies an analog input signal from a microphone or other tone signal source, making it suitable for further processing by the quantizing means 2 and the output summing amplifier 11.

The quantizing means 2 converts the analog voice or tone signal into discrete samples in time sequence, making it suitable for time sequential storage within the data memory 8.

The times at which the quantizer 2, the data memory 8, the writing address vector generator 5 and the address selector 7 perform their functions are discretely controlled and initiated by means of the master controller and timing generator 3. The writing address vector generator 5, when selected by the address selector 7, defines the specific addresses into which each sequential discrete time sample from the quantizer 2 is stored within the data memory 8. The number of address locations or contiguous memory length into which data is written into data memory, before it is over written on the next cycle, and the rate and direction which these data locations are accessed, are also discretely controlled and initiated by the master controller and timing generator 3.

The tuning control unit 4 establishes the musical key signature and tuning of the invention through manual control, selecting the sampling/quantizing rate or the contiguous memory length wherein the combined parameters control the angular velocity of both read and write vectors through the co-located contigious memory space. The tuning control unit 4 is connected to the master controller and timing generator 3 for transfer of the aforementioned combined parameters. For optimum tuning of the invention, the cyclic rate of the read vector and write vector is set to be equal to the frequency of a musical note an octave below a musical note that is a 5th musical interval (based on the 12th root of two) below the key signature of a key in which notes of its diatonic scale produce pleasing musical chords or plurality of voices when inputted to the invention.

The reading address vector generator 6 defines the addresses from which the contents of the data memory 8 is transfered to the output data converter 9. The address selector 7 alternately switches the address from write to read vector generators rators 5,6 respectively, under control of the master controller and timing generator 3.

The reading address vector generator 6 is controlled similarly to the write vector generator 5 in that they are both driven at the same rate of address change and over the same contiguous memory length. However, they are driven in opposite directions by the master controller and timing generator 3. It is this unique contra-rotation that translates the input signal waveform configuration, written into memory, into a time repetitive output waveform configuration of controlled periodicity when the input signal is read from the memory.

The output data converter 9 translates the quantized voice or tone data, read by the reading vector address generator 6 through the address selector 7, from the voice or tone data memory 8, into analog form for futher processing by level control 10 and summing amplifier 11.

Level control 10 provides the means for adjusting the amplitude or relative loudness of the background voices or tones to that of the unprocessed voice or tone that is directly routed from the input pre-amplifier 1 to the output amplifier 11.

The output summing amplifier 11 combines the input and processed, level controlled, signal from 10 to produce a signal for output to a power amplifier and loud speaker for conversion to audible sound.

Figure 2:
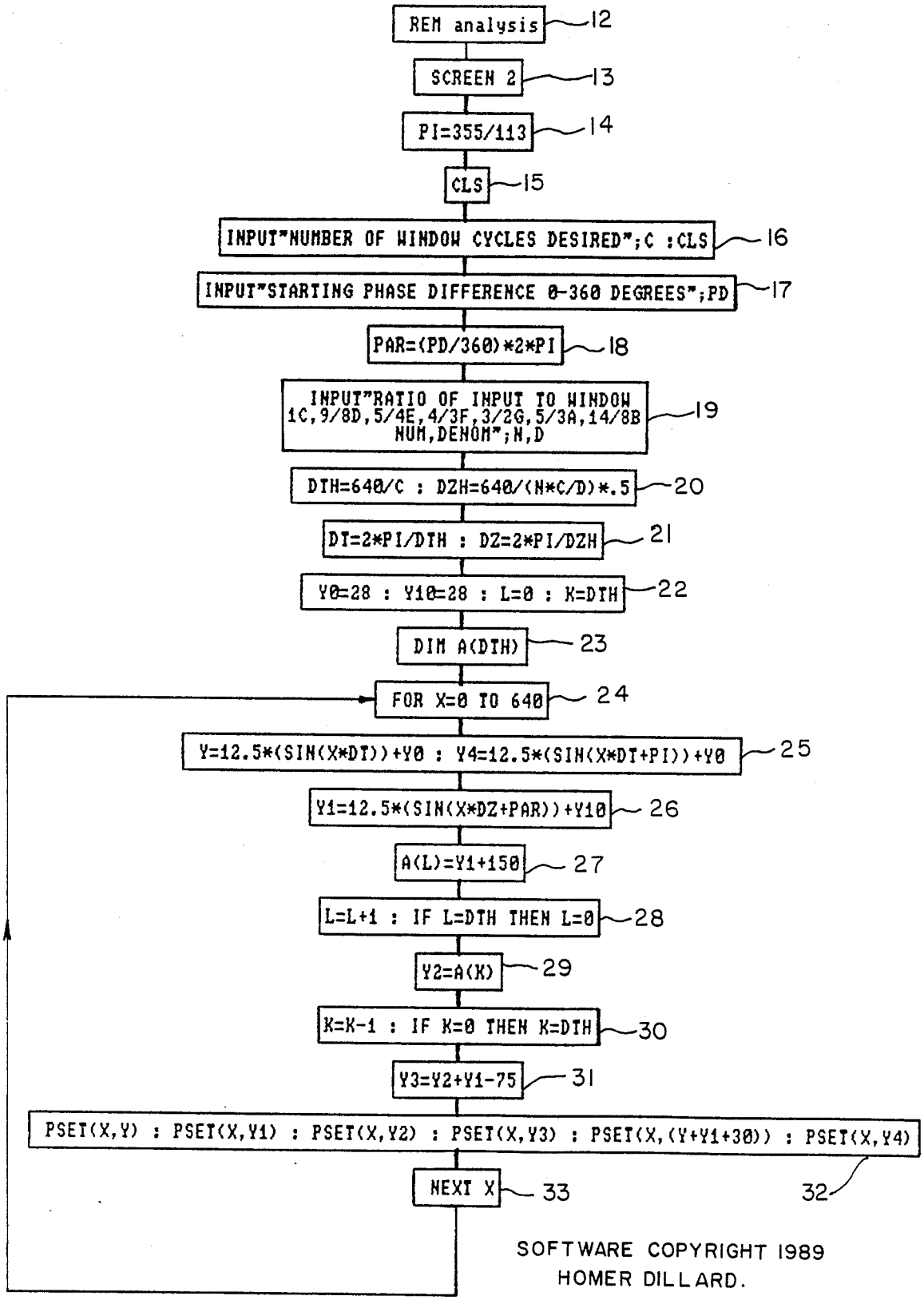
FIG. 2 is a flow chart of a computer program which illustrates the operation of the invention to enable a more thorough understanding of the means by which it translates an input signal waveform into a time repetitive output waveform.

FIG. 2 is a flow chart for a computer program which illustrates the operation of the invention and will be described and demonstrated herein to enable a more thorough understanding of how melodic harmonic frequencies are produced by the invention.

Block number 12 of FIG. 2 defines the program name, analysis. Block 13 establishes a graphics screen of 640 horizontal by 200 vertical pixels while block 14 provides a numeric value for the constant PI, 3.14159292, to be used later in the program. Block 15 clears the screen for graphics presentation during the run mode. Block 16 provides the means for inputting the number of rotational cycles for plotting of a unit vector whose angular velocity represents that of the read and write vectors.

Block 17 provides input for an angular phase difference between the input signal and that of the read and write vectors. Block 18 converts this input from degrees to radians for later use in the program. Block 19 provides for a numeric ratio input for fractions representing notes of a diatonic scale wherein unity frequency is one octave above the frequency of rotation of the read and write vectors. Block 20 establishes the number of pixels in 2PI radians for that of the read and write vectors and that of the input signal. Block 21 converts these increments into radians. Block 22 scales the y axis for the graphic plots of the input signal and the unit vector representing the read and write vectors to be on the same time or x axis, while initializing a count L to zero value and defining the contiguous simulated memory length to be equal to the number of pixels in one cycle of the unit vector representing the read and write vectors.

Block 23 establishes an array of memory locations equal to the simulated contiguous memory length. Block 24 starts the simulation and allows it to continue through 640 increments in the positive x direction. Block 25 computes the y value or amplitude of the rotating unit vector, while 26 computes the y value or amplitude of the input signal. Block 27 updates the array (writes to memory) for each x increment by writing in the value for the input signal amplitude at that point, plus an offset value when the signal is read by simulating the reverse reading vector (reading from memory) in Block 29. Block 28 increments the L count for the array address in 27, and limits it to the maximum established contiguous memory length from block 20. Block 29 defines the signal output from memory as an amplitude for each x increment. Block 30 decrements the address to move the read vector in reverse direction, while limiting the decremented range to the previously selected contiguous memory length. Block 31 simulates the summing of the processed input signal with the unprocessed input signal. Block 32 plots six waveforms as defined therein. Block 33 re-iterates the process until the 640th increment as defined by block 24 has been completed.

Figure 3:
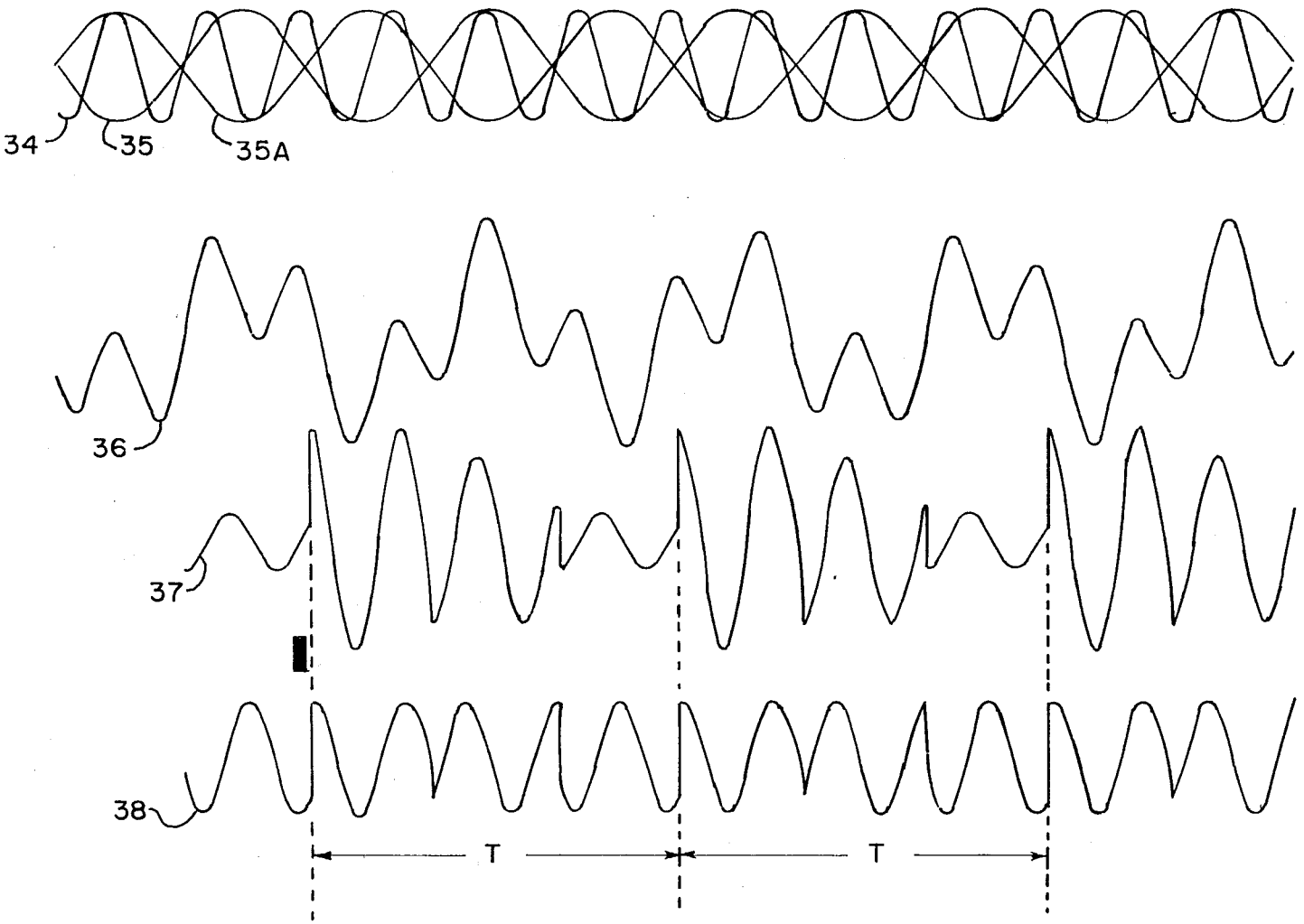
FIG. 3 is a computer generated graphical analysis from the program of FIG. 2 depicting one set of input, the read and write vectors generated in accordance with the invention and the resulting output waveforms.

The waveforms of FIG. 3 produced by the program flow charted in FIG. 2 illustrate the operation of the invention. Waveform 34 represents the input signal for a 4 to 3 ratio equivalent to a note of F in the key of F. Waveform 35 represents the write vector and waveform 35A represents the read vector. The waveform of 35 is one octave below the unity reference frequency defined by the 4 to 3 ratio of the input window, therefore 8 cycles of the input signal occur in 3 cycles of the unity reference frequency as shown. The waveform 36 represents the summation of waveforms 34 and 35. Note that there are no discontinunities in this wave form and therefore no higher harmonic frequencies produced. Waveform 37 represents the summation of waveforms 34 and 38 and illustrates the output from the summing amplifier 11 in FIG. 1. Higher harmonic frequencies are however, produced by the waveforms 37 and 38 due to the sharp discontinunities produced by the contra rotating read and write vectors 35 and 35A of the invention. Waveform 38 illustrates the output from output data converter 9 of FIG. 1.

Note that the waveforms of both 37 and 38 are periodically repetitive at intervals T defining fundamental frequencies lower than either the input frequency or that defined by the angular velocities of the contra-rotating read and write vectors. THis time repetitive waveforms, produced by the invention, contains pleasing musical harmonics (related to the input) that occur at integer multiples of the lowest fundamental frequency produced by the invention. These harmonics occur in varying intervals including 4th, 5th, and 6th harmonics resulting in the tonic musical triad and other integer harmonics, depending upon the tuning, input frequencies and relative phasing between the read/-write vectors and that of the input signal. Other waveforms including unison, time axially symmetric, quasi-stationary, amplitude modulated, frequency/phase modulated, reversed replicas of unchanged spectral content, or in rare circumstances completely cancelled signals can result by varying the input signal waveform configuration and the contiguous memory length or sampling rate.

The waveforms of FIG. 3 can be created for any note of the diatonic or chromatic scale by entry of the proper frequency ratios into the program represented by FIG. 2. For example, the frequency ratios and integer relationships for a diatonic scale in the key of F major is listed over 5 octaves as follows: C $\frac{1}{4}$, D 9/32, E 5/16,F $\frac{1}{3}$, G $\frac{3}{8}$, A 5/12, Bb 7/16, C $\frac{1}{2}$, D 9/16 ,E $\frac{5}{8}$, F $\frac{2}{3}$, G $\frac{3}{4}$, A 5/6,Bb $\frac{7}{8}$,C 1,D 9/8,E 5/4,F 4/3, G 3/2,A 5/3,Bb 14/8,C 2,D 9/4, E 5/2, F 8/3, G 3, A 10/3, Bb 7/2,C 4, D 9/2, E 5, F 16/3,G 6,A 20/3, Bb 7 and C 8.

Recently a branch of mathematics has been developed which represents a system as having dimensional excess, integer or non-integer fraction over the more conventional Euclidian dimensions. This so called Fractal analysis has been successfully applied to the description and computer simulation of visual scenes allowing complex realistic terrain imagery to be described and simulated by simple matematical manipulations.

Developed below is an analogy of the fractal analysis to the acoustical signal manipulation provided by the invention showing that fractal analysis can be used to compute the periods of the resultant waveforms that occur at a lower frequency than that of the input frequency. A Fractal has been defined by Benoit B. Mandelbrot in his book, *Fractals—Form, Chance and Dimension*, as a set for which the Hausdorff-Besicovitch dimension strictly exceeds the topological dimension. By equating the Hausdorff-Besicovitch dimension to the input frequency and the topological dimension to the read/write vector cyclic interception rate, a simple expression can be used to find the period of the resultant waveform produced by the invention. Let D, The Hausdoff-Besicovitch dimension, be the input ratio and the topological dimension Dt be 1, the interception rate of the read/write vectors. Fractals are where $D>Dt$ and the dimensional excess $(D-Dt)$ is herein defined as analogous to the period of the resultant waveform produced by the invention. The following lists the results of calculations of dimensional excess for Hausdorff-Besicovitch dimensions from 9/8 representing the musical note D through the integer 2.0 representing the musical note C of the diatonic scale in the key of F major. The note represented by the input ratio and the dimensional excess is given by a letter name of the musical scale. Also the letter names of the notes represented by the 4th, 5th and 6th harmonics of the fundamental frequency of the dimensional excess note frequency is defined. Note that these are the tonic chords in the key represented by the dimensional excess note.

| INPUT RATIO | DIMENSIONAL EXCESS | HARMONICS 4TH. 5TH. 6TH |
|---|---|---|
| 9/8 D | $\frac{1}{8}$ C | C, E, G |
| 5/4 E | $\frac{1}{4}$ C | C, E, G |
| 4/3 F | $\frac{1}{3}$ F | F, A, C |
| 3/2 G | $\frac{1}{2}$ C | C, E, C |
| 5/3 A | $\frac{2}{3}$ F | F, A, C |
| 14/8 Bb | $\frac{3}{4}$ G | G, B, D |
| 2.0 C | 1.0 C | C, E, G |

This analogy of Fractal mathematics as applied to the present invention provides a convenient means of representing the input-output relationships of the Voice to Music Converter.

Figure 4:
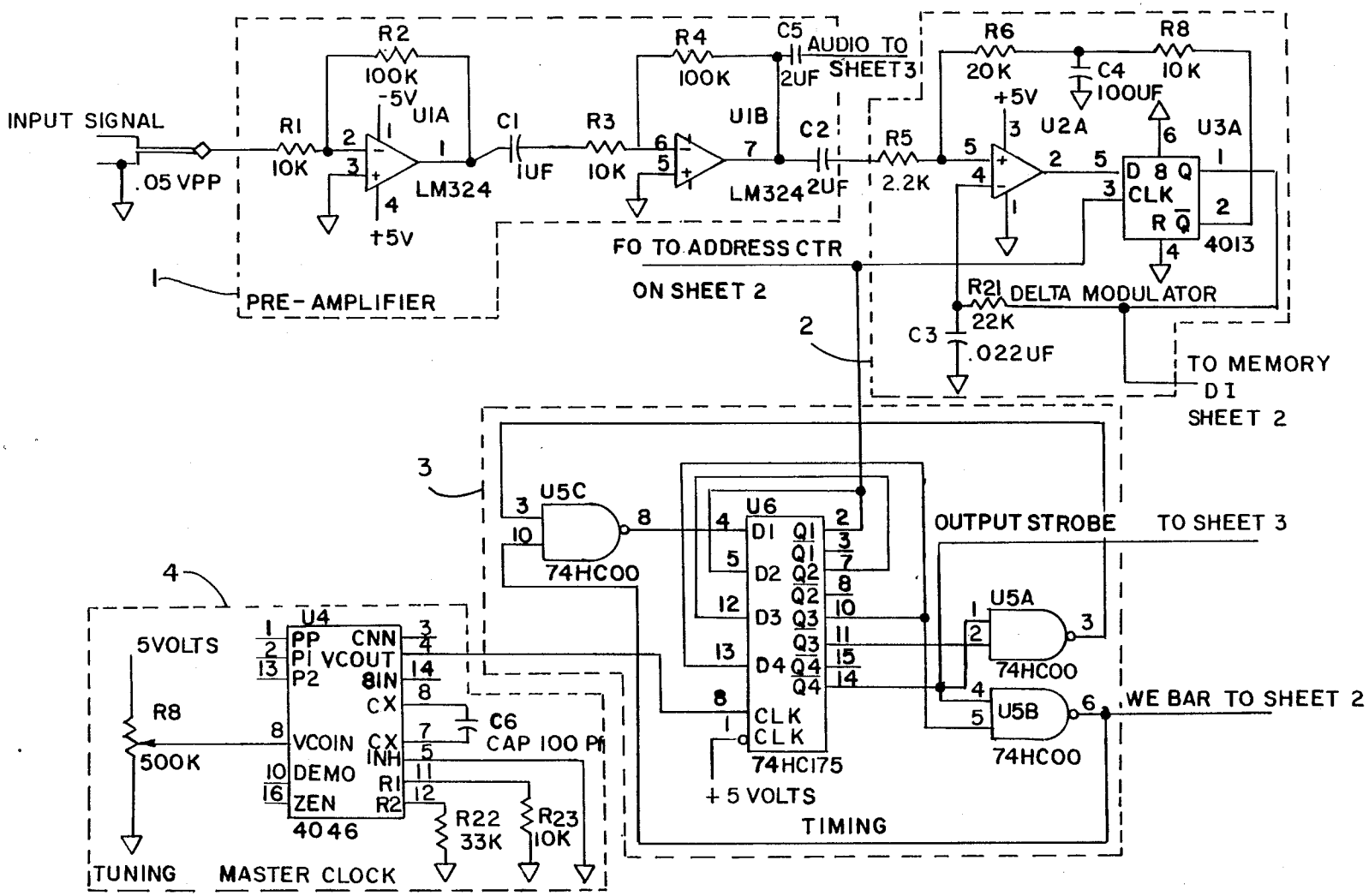
FIGS. 4,5 and 6 comprise a schematic diagram of one embodiment of the invention illustrating hardware implementation.
Figure 5:
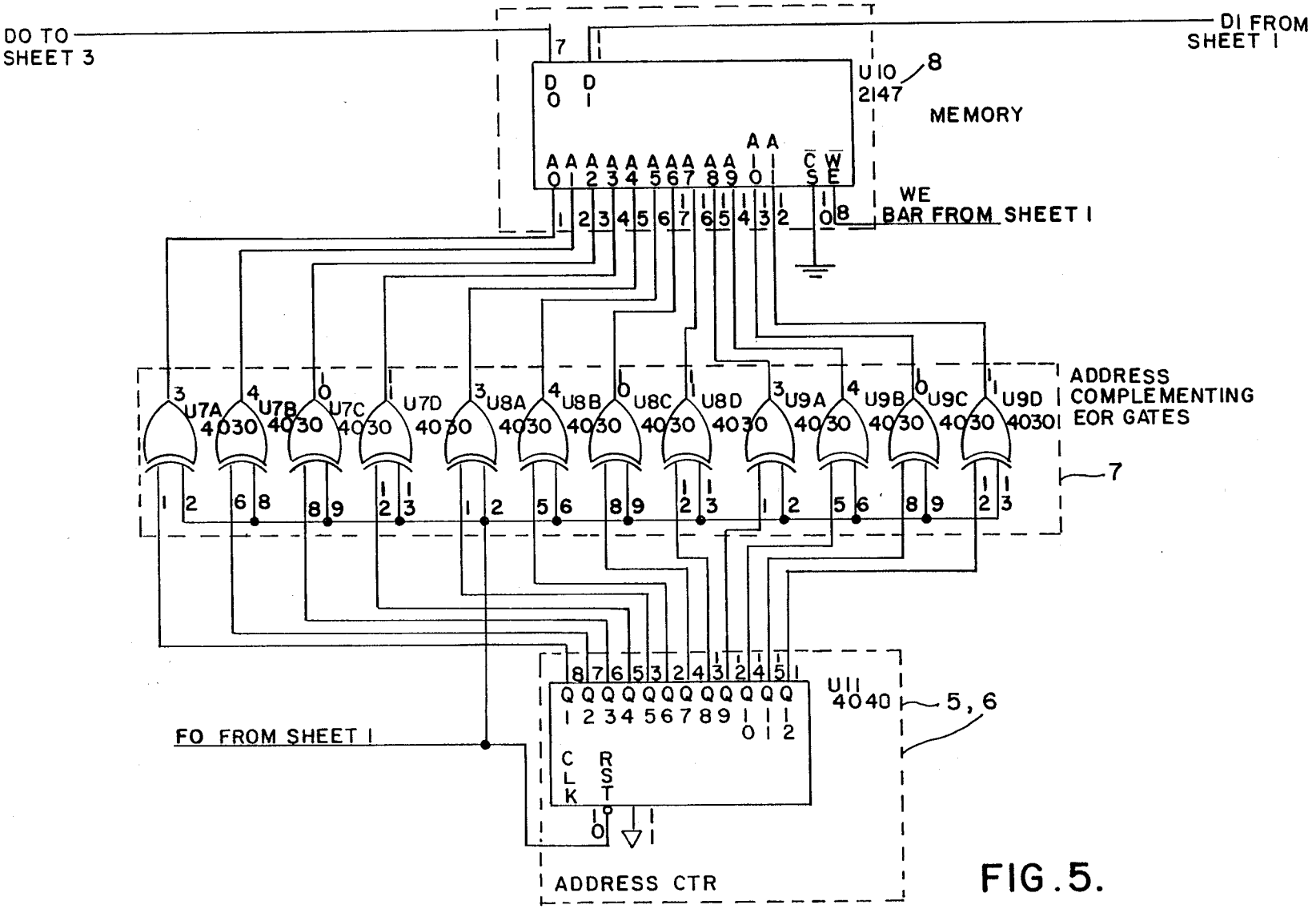
Figure 6:
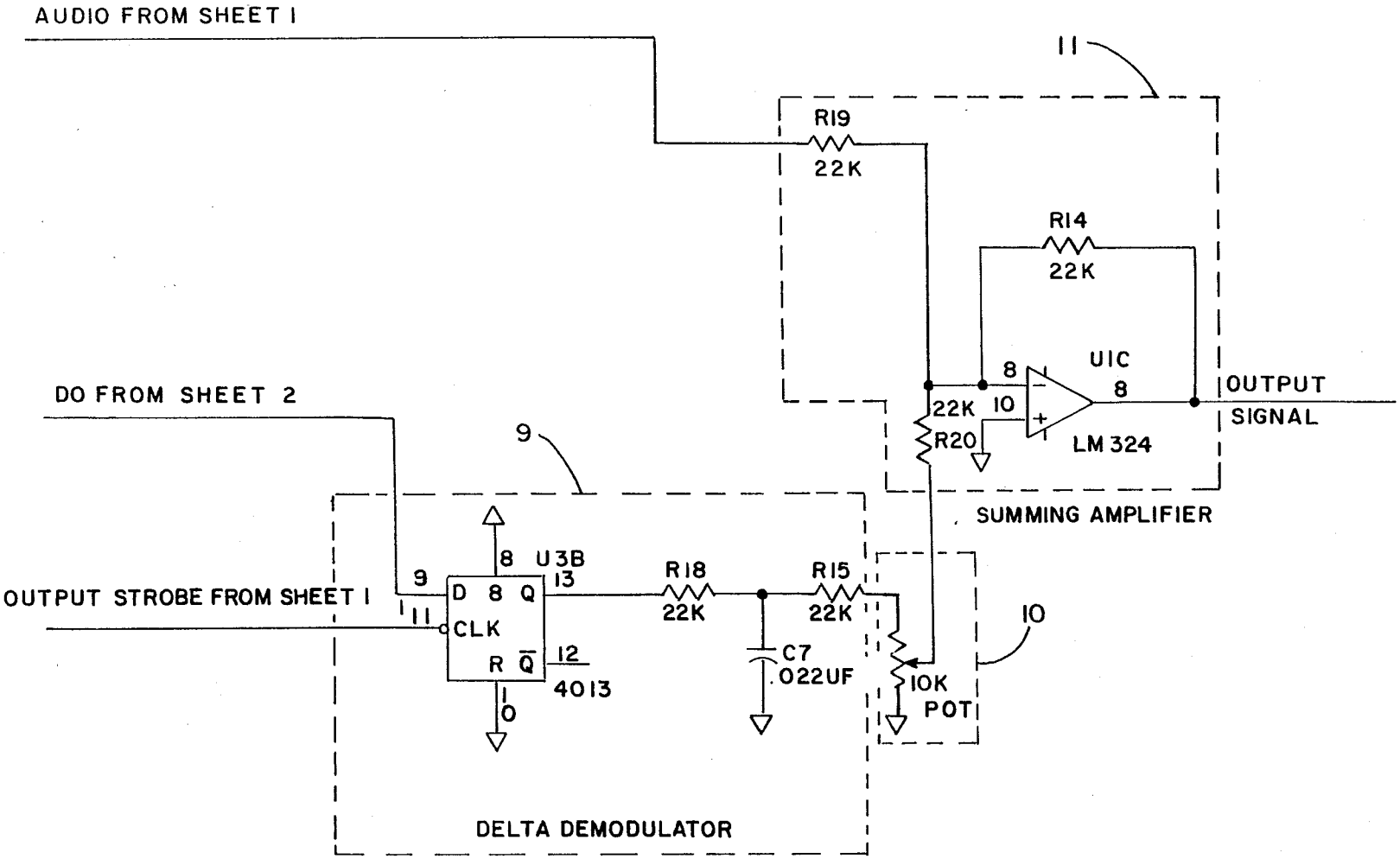

FIGS. 4, 5, and 6 comprise a schematic diagram for a simple hardware implementation of the invention. This schematic will enable anyone versed in the art to construct a voice to music converter from commercially available components.

The circuit of FIGS. 4, 5, and 6 comprises elements in dashed blocks that are interconnected to perform the functions required by the preferred embodiment of FIG. 1. These blocks are numbered sequentially to correspond with each of the blocks or symbols from FIG. 1.

The pre-amplifier of block 1 performs the amplification required to condition a 50 millivolt peak to peak microphone signal into a 5 volt peak to peak signal for input to blocks 2 and 11, the quantizing means and the output summing amplifier means respectively. Block 2, the quantizing means, is a linear delta modulator that digitizes the analog signal into a serial one bit data stream for input the voice data memory block 8. This device comprises an analog comparator, a D flip flop and an integrator. As is customary with these devices, the integrator output is compared to the analog input and the digital output bit set on the sign of the result. The quantizing rata is generated by the master control and timing generator block 3 and the tuning control block 4. Tuning is accomplished by voltage input to a voltage controlled oscillator by means of a potentiometer shown in block 4.

The master controller and timing generator of block 3 is comprised of a quad D clocked flip flop array that divides the voltage controlled oscillator of block 4 by eight; three two-input NAND gates condition the outputs to drive the quantizing means of block 2, the voice data memory of block 8, the read/write address vector generator of block 5, the address selector of block 7, and the output data converter of block 9.

The address counter of block 5 provides the means for generating both the read and write address vectors. Block 5, in conjuction with the address selector of block 7, provide a means for generating and complementing an address; one address counter creates both the read and write addresses by complementing the single binary address through the exclusive OR gate of block 7. The address output from block 7 is input to the voice data memory of block 8. This is a 4096 bit by one array and is used to store the single bit quantized analog input data from block 2 as the contents of the address specified by the write vector binary number created and selected by blocks 5 and 7 respectively.

The output data converter of block 9 converts the one bit serial digital data from the voice data memory of block 8 into analog form under control of the master controller and timing generator of block 3. This is a simple clocked D type flip flop with an output integrator as shown in block 9. The addresses from which the output data is read is the reverse sequence from which it was written as defined by blocks 3, 5, and 7.

The output level potentiometer of block 10 provides the means for adjusting the relative gain or loudness between the input signal and the background voices or tones from the output data converter of block 9.

Block 11 is a summing amplifier whose inputs are the outputs from blocks 10 and 1 respectively. Block 11's output is the final signal produced by the invention and is externally routed to the power amplifier and loud speaker through a signal connecting means.

Figure 7:
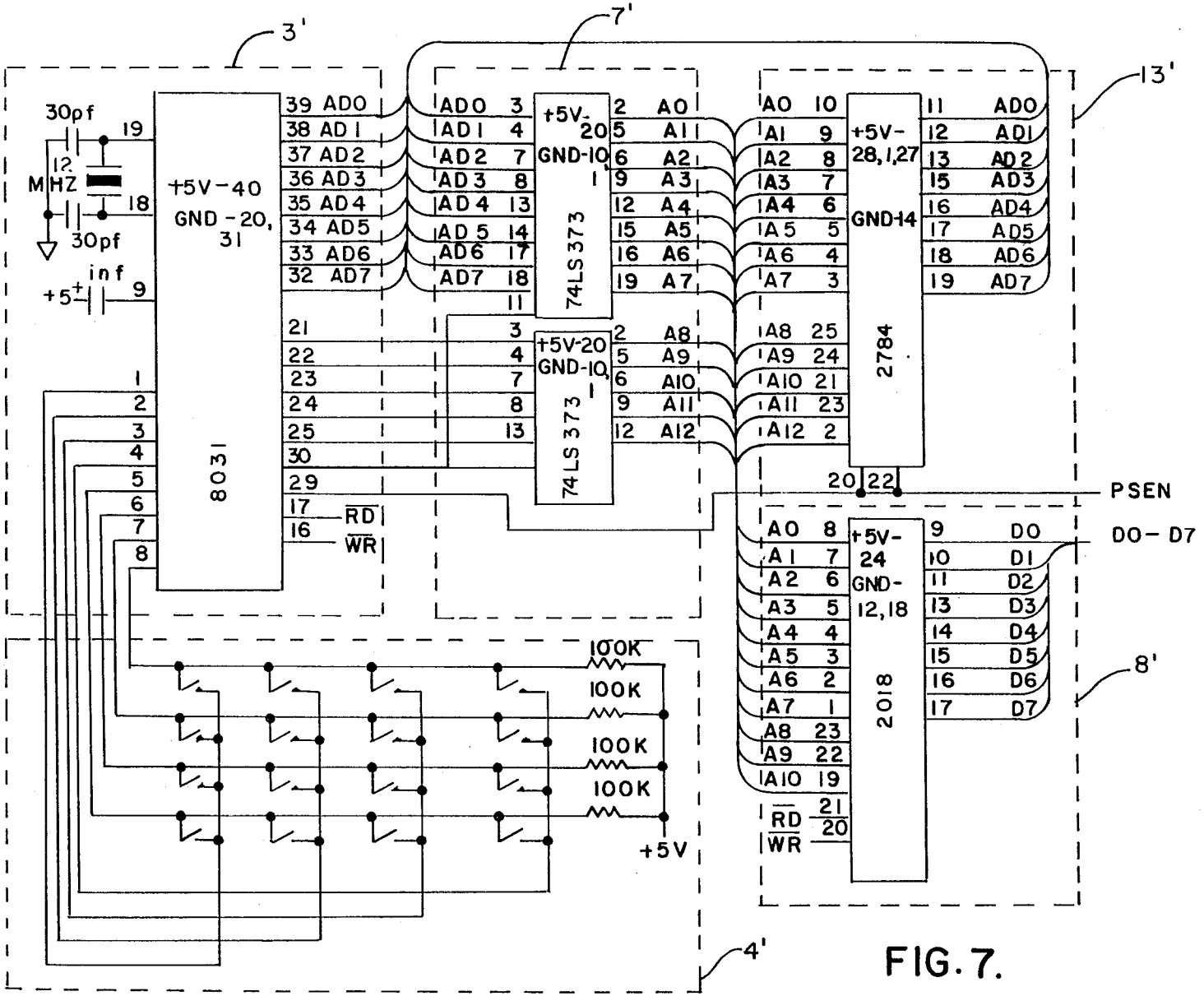
FIGS. 7 and 8 comprise a schematic diagram of a second embodiment using microprocessor control of hardware and a software implemented algorithm.
Figure 8:
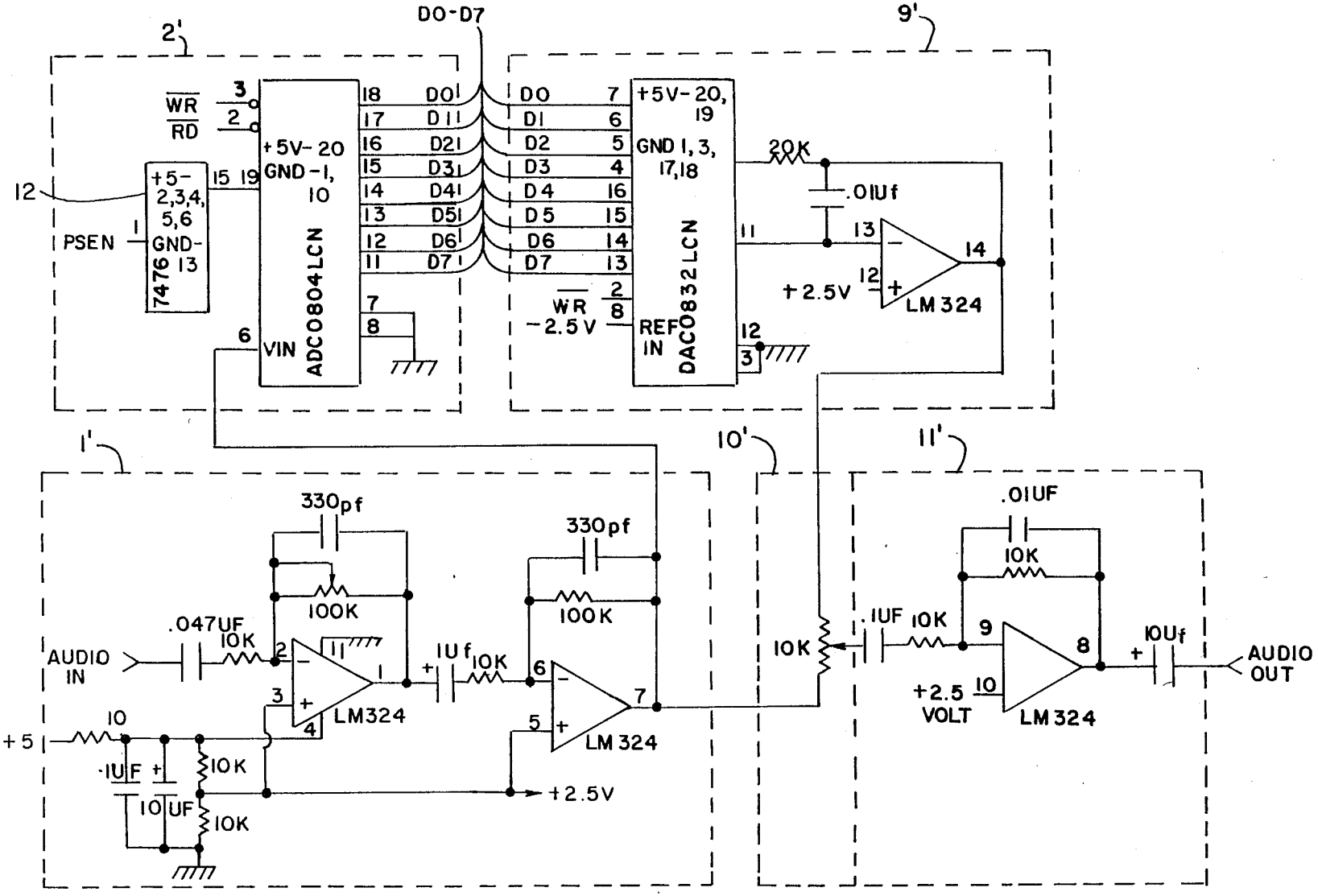

FIGS. 7 and 8 comprise a schematic diagram of an implementation that uses microprocessor control of hardware via a software algorithm developed from the teachings of the present invention. This schematic is comprised of elements shown in dashed blocks that implement the preferred embodiment of FIG. 1 using microprocessor control of hardware and a software implemented algorithm.

Block 1' is a microphone preamplifier with a gain of 100 biased at Vcc/2 rather than at ground potential. Block 1' drives block 2', the quantizing means, and block 11' the summing amplifier, as shown by FIG. 1.

The quantizing means in this circuit, block 2', is an eight bit parallel analog to digital coverter whose sampling rate is determined by the master controller and timing generator of block 3'via a JK flip flop of block 12'. The master controller and timing generator is comprised of a 12 megahertz crystal and a single chip microprocessor shown in block 3'. The microprocessor is contolled by a programmable read only memory PROM of block 13'.

The algorithm developed from FIG. 1 is coded in digital form and established as a program in the contents of memory addresses within the PROM of block 13'. The functions of the writing address vector, the reading address vector generator, tuning control, memory control and other hard wired functions of the invention are accommodated in the programmable read only memory of block 13'.

The address latch of block 7' performs the function of the address selector of FIG. 1. The tuning control unit of block 4' is comprised of discrete push button momentary contact switches that select the specific key signatures of the invention and provide the continuous tuning input increments of ±one half step. Block 7' is connected directly to the microprocessor of block 3 to perform the timing control function.

The output data converter of block 9' is an eight bit parallel digital to analog converter used to translate the processed digital signal input from the voice data memory into analog form. The output from block 9', the background voice, is a buffered signal that drives one end of the level control potentiometer of block 10'. The other end of the level control potentiometer is directly driven by the pre-amplifier input signal from block 1'. The wiper of the level potentiometer drives the output amplifier of block 11'. This configuration allows the user to smoothly adjust the relative loudness of the input voices or tones and the background voices or tones. The output of the amplifier of block 11' is the final signal produced by the invention and is externally routed to the power amplifier and loud speaker through a signal connecting means.

There are various changes and modifications which may be made to the invention as would be apparent to those skilled in the art. However, these changes or modifications are included in the teaching of the disclosure, and it is intended that the invention be limited only by the scope of the claims appended hereto.

What is claimed is:

1. A method of reversing the normal forward time sequence of an acuostic signal's loudness level variation in a controlled manner, and then combining a normal forward time sequenced acoustic signal with a reversed sequenced signal to produce acoustic signals of pleasing musical, harmonic structure with respect to the normal forward time sequenced acoustic signal.

2. The method of claim 1 wherein the method of reversing the time sequence of the normal acoustic signal is accomplished by storing the normal forward time sequenced acoustic signal, as it occurs in real time, over a pre-determined time interval and subsequently retrieving the stored acoustic signal in reverse time sequence over the same pre-determined time interval.

3. The method of claim 1, wherein the combining method for the normal forward sequenced acoustic signal and that of the reversed time sequenced acoustic signal is achieved by either adding and/or substracting the instantaneous magnitudes plus signs of the forward and reverse time sequenced acoustic signal's sound pressure level variations.

4. The method of claim 1 wherein the controlled manner by which the reversing of the normal forward time sequenced acoustic signal is achieved is by making the pre-determined time interval of claim 27 equal to twice the reciprocal of a topological dimension of unity for which the greater Hausdorff-Besicovitch fractal dimensions produce dimensional excess and thereby the resulting signals of, musical, harmonic structure.

5. In a apparatus for electronically changing the pitch of a musical instrument or the human voice, wherein the pitch change is produced by digitizing, writing, and/or reading a common memory space at differing rates, said rates creating undesirable harmonies unsuited to pleasing harmonic structure, the improvement comprising means for translation of an input signal waveform into a time repetitive output waveform of controlled periodicity creating desirable harmonic structure; said translation means comprising means for generating contra rotating read and write vectors rotating at substantially equal velocities or address change rates through said controlled periodicity.

6. In a apparatus for electronically changing the pitch of a musical instrument or the human voice, wherein the pitch change is produced by digitizing, writing and/or reading a common memory space at differing rates, said rates creating undesirable harmonics unsuited to pleasing harmonic structure, the improvement comprising means for translation of an input signal waveform into a time repetititive output waveform of controlled periodicity creating desirable harmonic structure; said translation means comprises means for generating contra rotating read and write vectors set to contra-rotate at angular velocities equal to that of a musical note one octave below a musical note that is a 5th musical interval (based on the 12th root of two) below the key signature of a key note in which notes of its diatonic scale produce musical chords or plurality of voices when input to the device.

7. The apparatus of claim 4 wherein controlled parameters are used to establish the angular velocities of said contra-rotating read and write vectors through the common memory space comprising the quantizing or sampling rate and the contiguous memory length.

8. The apparatus of claim 5 wherein the said angular velocities are selectable over 11 chromatically related key signatures plus incremental tuning of ±one half step.

9. In a apparatus for electrically changing an input waveform of a musical instrument or the human voice comprising:

means for generating an input waveform from said musical instrument or said voice;

means for quantizing said input waveform into a plurality of component waveforms;

means for generating a process waveform comprising means for generating contra-rotating read and write vectors through said input waveform rotating at equal angular velocities or address change rates through a controlled periodicity;

said process waveform being comprised of a plurality of harmonics, each having an integar harmonic relationship with respect to the combination of said input waveform, and said controlled periodicity.

10. The apparatus of claim 9 further comprising pre-amplification, means to condition an input signal from a microphone or other acoustic transducer/generator means into a format suitable for input to a quantizing means.

11. The apparatus of claim 10, further comprising a quantizing means to digitize the input signal into a quantized input signal comprising discrete time samples suitable for input to a data storage memory means.

12. The apparatus of claim 11 further comprising a data storage memory means for time sequential storage of said quantized input signal in real time over a predetermined time interval within a controlled contigious memory length wherein in said data storage memory means said memory is over written with new contigious real time signal data on each memory writing cycle defined by the said pre-determined time interval as established by address selection, read/write vector generation and a master controller and a timing generator means.

13. THe apparatus of claim 12, wherein said data storage memory means comprises:

means for obtaining forward and reversed time sequential samples;

means for retrieving said reversed time sequential samples; and, means for transferring said retrieved reversed time sequential samples to an output data converter which contains means for converting the retrieved reversed time sequential samples to analog form, whereby said data storage memory means receives the forward and reversed time sequential samples in a plurality of forward and reverse address locations, respectively.

14. The apparatus of claim 13, wherein said data storage memory means further comprises means for address selection whereby said means for address selection is comprised of a plurality of exclusive OR gating means for providing controlled complementing of said forward address locations and for providing said reverse address locations for both read and write vector address generation.

15. The apparatus of claim 14, further comprising means for reading and writing vector address generation in the form of a binary number sequence and for resetting the sequence to zero at said predetermined time interval; wherein said sequence generated is comprised of said vector address and said binary complement by means of said exclusive OR gating means thereby providing both read and write vector address generation under the control of said master controller and said timing generation means.

16. The apparatus of claim 15 wherein a manually selectable tuning means controls said master controller paid, said timing generation means to initiate and discretely control said means for generating said component waveforms, said data storagememory means, said output data converter, said means for address selection, and said read and write address vector generators by means of timing signals controlled in duration and oriented in time sequence to control writing, reading, selection and conversion of said data from said data storage means.

17. The apparatus of claim 9 further comprising a summing amplifier to provide the means for combining the original signal input to the invention with the signal as processed by the invention.

18. The apparatus of claim 9 further comprising a potentiometer for controlling the relative loudness between the input signal and background voices or plurality of harmonic frequencies.

19. The apparatus of claim 9 further comprising an output connecting means for the transfer of the signal output from the invention to an external power amplifier and loud speaker means for conversion to audible sound.

20. The aparatus of claim 9 including additional waveform control means whereby the changed waveform from reading and writing vectors at the same angular velocities but in opposite directions results in substantially zero information loss in the output signal relative to the input signal.

21. THe apparatus of claim 20 wherein the timbre of the musical chord output from the invention can be varied in the number of voices/harmonics by incrementing or decrementing the relative phase between the angular velocity of the input note frequency and that of the read/write vectors.

22. The apparatus of claim 21 wherein unison notes or voices are output from the invention when unison notes or voices are input to the invention if said unison input notes or voices are equal to or octavely or third harmonically related to the cyclic rate of the read/write vectors.

23. The apparatus of claim 21 further comprising an input signal waveform having a variable shape based upon varying at least one of a pitch, phase, amplitude, frequency, harmonic content, contiguous length, sampling rate, and relative gain characteristics between said processed and said input signal thereby generating an output signal having waveforms selected from time axially symmetric reversed replicas, quasi-stationary reversed replicas, amplitude modulated reversed replicas, and frequency/phase modulated reversed replicas of said input waveform as well as completely cancelled signals without changing the spectral content of the input waveform.

24. In a apparatus for electronically changing the pitch of a musical instrument or the human voice, wherein the pitch change is produced by digitizing, writing, and/or reading a common memory space at differing rates, said rates creating undesirable harmonies unsuited to pleasing harmonic structure, the improvement comprising means for translation of an input signal waveform into a time repetitive output waveform of controlled periodicity creating desirable harmonic structure; said translation means comprising means for generating contra rotating read and write vectors rotating at substantially equal velocities or address change rates through said controlled periodicity means for causing the interception of said contra rotating read and write vectors in a common memory space, thereby generating a waveform including sub-harmonic frequencies.

25. The apparatus of claim 10 wherein the said created sub-harmonic frequencies results in harmonic frequencies whose interger multiples include the 4th, 5th and 6th harmonics including tonic triads and/or other integer harmonics that are musically pleasing when related to the input signal.

26. The apparatus of claim 7 wherein the said harmonic frequencies are the result of a crystal controlled oscillator and the singers voice input requiring correct pitch from the singer to achieve the most pleasing harmonies, thereby making the invention effective as a voice training medium.

27. The apparatus of claim 26 wherein the result of said crystal controlled oscillator is deviated about its nominal frequency causing the said harmonics to deviate a semi-tone producing a "vibrato" or frequency modulation on the said harmonic frequencies.

* * * * *

UNITED STATES PATENT AND TRADEMARK OFFICE

CERTIFICATE OF CORRECTION

PATENT NO. : 4,915,001

DATED : April 10, 1990

INVENTOR(S) : Homer Dillard

It is certified that error appears in the above-identified patent and that said Letters Patent is hereby corrected as shown below:

On the title page, in the illustrative and Sheet 1 of the drawings, an arrow needs to be applied to the outermost line extending from the Master Controller and Timing Generator to the Quantising Mean.

In column 1, Line 13, correct the spelling of "pitch."

In Lines 15 & 16, correct the spelling of "analog."

In Line 34, correct the spelling of "wherein."

In Line 62, change "invention" to inventor.

In column 2, Line 25, change "change" to changes.

In Line 65, change "cause" to caused.

In column 3, Line 16, change "turning" to tuning.

In column 4, Line 26, delete "embodiment, second occurance."

In column 5, Line 3, delete "rators" after generator.

UNITED STATES PATENT AND TRADEMARK OFFICE

CERTIFICATE OF CORRECTION

PATENT NO. : 4,915,001

DATED : April 10, 1990

INVENTOR(S) : Homer Dillard

It is certified that error appears in the above-identified patent and that said Letters Patent is hereby corrected as shown below:

In column 6, Line 45, change "THis" to --This--.

In column 7, Line 6, change "fraction" to fractions.

In column 10, Line 6, change "27" to --2--.

In column 11, Line 17, change the captial "H" to a small "h" in THe.

In column 11, Line 51, change "paid," to --and--.

In Line 53, place a space between storage and memory.

In column 21, Line 10, change the capital "H" to a small "h" in The.

Signed and Sealed this

Thirtieth Day of April, 1991

*Attest:*

*Attesting Officer*

HARRY F. MANBECK, JR.

*Commissioner of Patents and Trademarks*